US005806505A

United States Patent [19]

Herbert

[11] Patent Number: 5,806,505

[45] Date of Patent: Sep. 15, 1998

[54] IGNITION COIL ARRAGEMENT FOR MULTICYLINDER INTERNAL COMBUSTION ENGINES

[75] Inventor: Wolfgang Herbert, Benningen, Germany

[73] Assignee: Robert Bosch GmbH, Stuttgart, Germany

[21] Appl. No.: 776,684

[22] PCT Filed: Mar. 23, 1996

[86] PCT No.: PCT/DE96/00500

§ 371 Date: Feb. 18, 1997

§ 102(e) Date: Feb. 18, 1997

[87] PCT Pub. No.: WO97/04470

PCT Pub. Date: Feb. 6, 1997

[30] Foreign Application Priority Data

Jul. 22, 1995 [DE] Germany ..... 195 26 867.9

[51] Int. Cl.[6] ..... F02P 3/06

[52] U.S. Cl. ..... 123/621

[58] Field of Search ..... 123/621, 634, 123/594, 605, 608

[56] References Cited

U.S. PATENT DOCUMENTS

| | | | |
|---|---|---|---|
| 4,462,380 | 7/1984 | Asik | 123/621 |
| 4,627,407 | 12/1986 | Betz | 123/621 |
| 5,156,136 | 10/1992 | Okumura | 123/621 |

FOREIGN PATENT DOCUMENTS

| | | | |
|---|---|---|---|
| 36 10 067 | 10/1986 | Germany | 123/621 |

*Primary Examiner*—Raymond A. Nelli
*Attorney, Agent, or Firm*—Kenyon & Kenyon

[57] ABSTRACT

An ignition coil arrangement for a multicylinder internal combustion engine comprising at least one coil unit, which is able to be simply installed even under restricted spatial conditions. To this end, the coil unit, which contains a primary winding and a secondary winding attached to two spark plugs, is designed with the windings as a divided and mechanically separated coil unit. One primary partial winding and an associated secondary partial winding are each combined to form partial winding, which are electrically connected in series via a primary connector lead or a secondary connector lead (26), and are jointly driven by way of a contact element. The ignition coil arrangement is used, in particular, in motor vehicles.

4 Claims, 2 Drawing Sheets

IGNITION COIL ARRAGEMENT FOR MULTICYLINDER INTERNAL COMBUSTION ENGINES

BACKGROUND INFORMATION

The present invention relates to an ignition coil arrangement for multicylinder internal combustion engines. An ignition coil arrangement of this type is also known from German Patent 36 10 067 C3.

The ignition coil arrangement is comprised of a plurality of coil units, each driven as a kind of multiple ignition coil by a driver stage. Each coil unit is composed of a primary winding and of a secondary winding attached to two spark plugs. All of the coil units are combined to form one assembly having a common casing. This results in an ignition coil arrangement of sizable dimensions, so that difficulties can be encountered when installing such an ignition coil arrangement under the cramped mounting conditions existing in the engine compartment of an internal combustion engine.

SUMMARY OF THE INVENTION

In contrast, it is an advantage of the ignition coil arrangement according to the present invention that it avoids the aforementioned deficiency to a satisfactory degree. The ignition coil arrangement is provided for this purpose with at least one coil unit as a multiple ignition coil, whose primary winding and secondary winding each have a divided and mechanically separated design. One primary partial winding and one secondary partial winding each are combined to form a partial winding and a plurality of partial windings are electrically connected in series.

Thus, the ignition coil arrangement of the present invention is comprised of a plurality of small units, each one of which, because of its small unit volume, particularly given a bar-type core, is able to be placed by itself even under cramped installation conditions, so that this ignition coil arrangement has varied uses and can be manufactured in large quantities and, thus, cost-effectively.

By partitioning in each case one primary winding and the secondary winding into electrically series-connected partial windings containing one segment of the primary winding and the associated secondary winding, material is also economized, since, for example, the iron core of the partial windings only has to be designed for a portion of the ignition voltage.

DETAILED DESCRIPTION OF THE DRAWING

Figure 1:
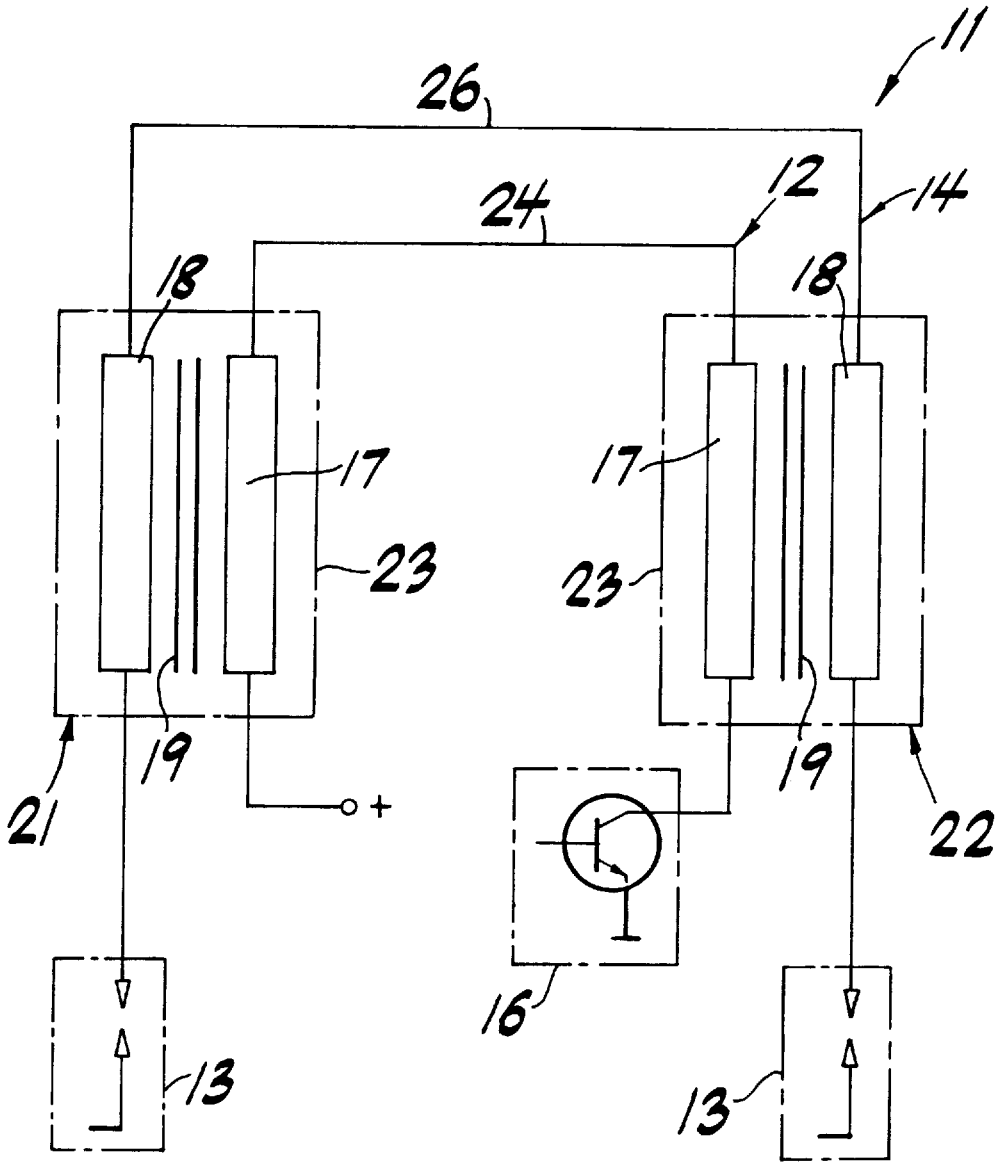
FIG. 1 shows a schematic drawing of an exemplary circuit diagram according to the present invention.
Figure 2:
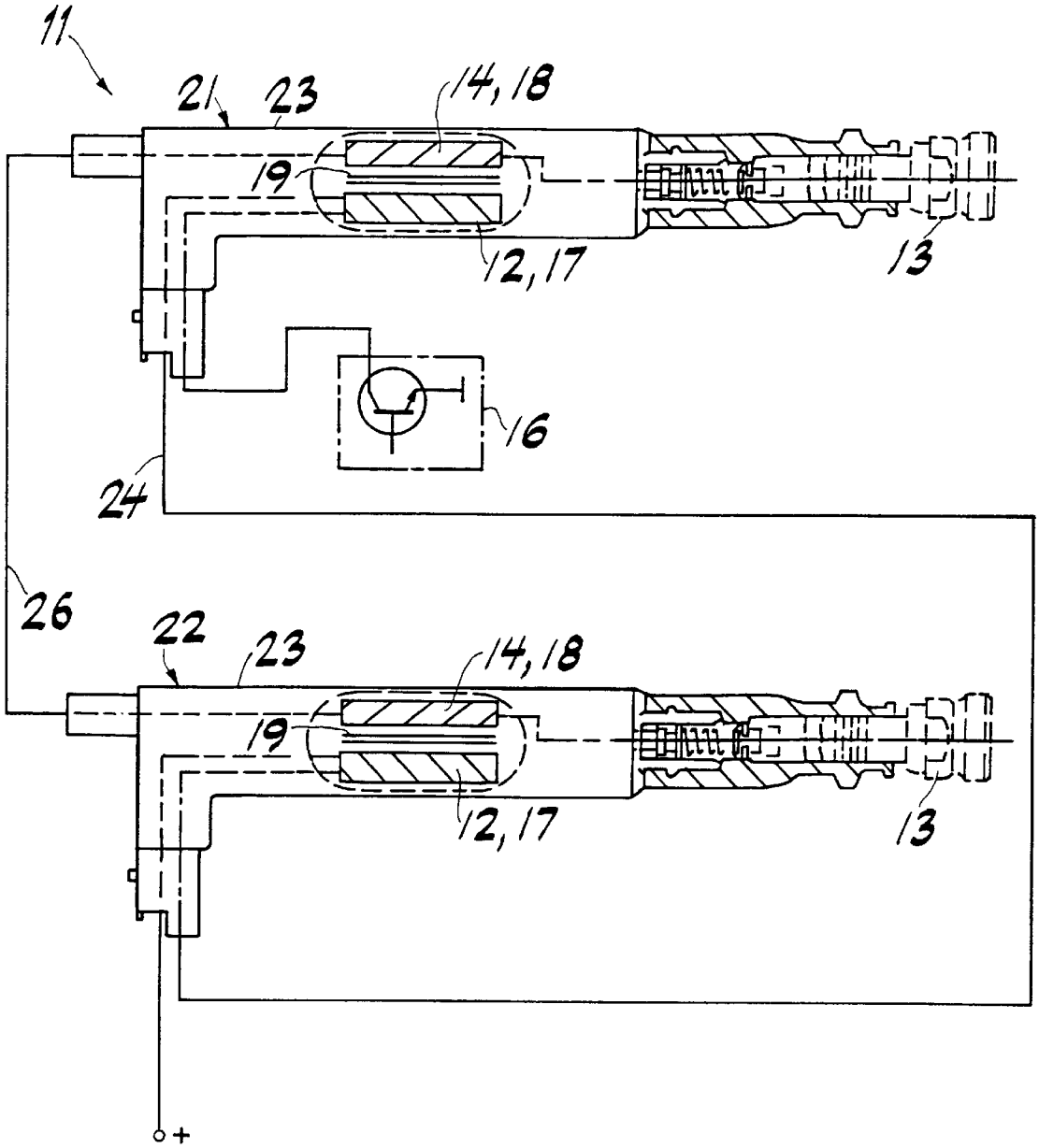
FIG. 2 shows a more detailed circuit diagram of the coil unit.

An ignition coil arrangement for a multicylinder internal combustion engine is composed of a plurality of substantially identical coil units 11, of the multiple ignition coil type, realized as dual ignition coils, one of which is shown in FIGS. 1 and 2.

Each coil unit 11 contains a primary winding 12 and a secondary winding 14 attached to two spark plugs 13, and is controlled by a contact element 16 in the form of a driver stage, symbolized here by the graphic symbol of a transistor.

Both primary winding 12, as well as secondary winding 14 are split as mechanically and spatially separated windings into two primary partial windings 17 or two secondary partial windings 18. One primary partial winding 17 and one secondary partial winding 18 each is combined, together with an iron core 19 disposed therein, to form a first partial winding 21 or second partial winding 22. Each of partial windings 21, 22 is arranged in a casing 23.

The one end of the two primary partial windings is joined in each case to a common primary connector lead 24 and the one end of the two secondary partial windings 18 is joined in each case to a common secondary connector lead 26.

While each other end of the two secondary partial windings 18 leads to one spark plug 13, the other end of primary partial winding 17 of the first partial winding 21 leads to the positive pole of the motor vehicle's power supply, and the other end of primary partial winding 17 of the second partial winding 22 to contact element 16 that is connected to chassis potential.

A coil unit 11 having a contact element 16 can also be optionally comprised of three or more primary partial windings 17 or secondary partial windings 18, given a substantially identical design and series interconnection.

By mechanically and spatially separating coil units 11 into electrically series-connected partial windings 21, 22, compact units are produced, which are able to be simply installed under restricted spatial conditions.

What is claimed is:

1. An ignition coil unit for a multicylinder internal combustion engine, comprising:

a primary winding, the primary winding including a plurality of primary partial windings, a secondary winding, the secondary winding including a plurality of secondary partial windings, the secondary winding being electrically connected to at least one spark plug, and at least one contact element for controlling a current of the primary winding on the basis of at least one driving signal;

wherein each one of the plurality of primary partial windings is combined with a respective one of the plurality of secondary partial windings to form one of a plurality of partial windings, the plurality of partial windings being electrically connected in series.

2. The ignition coil unit according to claim 1, wherein the contact element includes a driver stage and the plurality of partial windings are driven jointly by the contact element.

3. The ignition coil unit according to claim 2, further comprising a plurality of spark plugs, wherein each one of the plurality of partial windings is connected to one of the plurality of spark plugs.

4. The ignition coil unit according to claim 1, wherein the ignition coil unit includes a dual ignition coil.

* * * * *